US006124827A

United States Patent [19]

Green et al.

[11] Patent Number: 6,124,827

[45] **Date of Patent: *Sep. 26, 2000**

[54] PHOTONIC PHASE AND TIME DELAY-STEERED ARRAYS

[76] Inventors: Leon Green, 9 Crestwood Dr., Framingham, Mass. 01701; Joseph A. Preiss, 40A Nutting Rd., Westford, Mass. 01886

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,832

[22] Filed: Sep. 2, 1997

Related U.S. Application Data

[63] Continuation-in-part of application No. 08/778,201, Dec. 30, 1996, Pat. No. 5,977,911.

[51] Int. Cl.[7] ..... H01Q 3/22

[52] U.S. Cl. ..... 342/375; 342/372; 342/157

[58] Field of Search ..... 342/375, 371, 342/372, 157, 158

[56] References Cited

U.S. PATENT DOCUMENTS 5,583,516 12/1996 Lembo ..... 342/375
5,718,226 2/1998 Riza ..... 128/660.01

OTHER PUBLICATIONS

Russell, et al., "Photonically controlled, wavelength division mulitiplexing (WDM) active array," Raytheon Electronic System Laboratories, Tewksbury, Massachusetts 01976, Presented Jan. 27, 1994, at International Society of Optical Engineers Mtg. Proceedings.

*Primary Examiner*—Theodore M. Blum
*Attorney, Agent, or Firm*—Cesari and McKenna, LLP

[57] ABSTRACT

A switching unit for a photonic phased array for use in the microwave frequency bands uses lasers and other photonic devices to perform various functions in the phased array such that signals can be carried to the antenna elements on a single optical fiber. In one embodiment of the invention, a set of fixed phase shifters generates signals each having different phases. In the switching unit, each resulting signal, which is of a particular phase, modulates a laser of a different color. Each different laser color is thus associated with a given phase. Alternatively, time-delay units produce signals of different time-delay states which signals are then associated with lasers of different colors. The lasers are then used for selection of the signals to be applied to each element in the array. The laser signals are combined and carried on a single optical fiber to an optical network of tunable optical filters which can be located at the element level. The single optical filter allows the phase shifters and lasers to be located remotely from the antenna elements. Using an associated beam steering controller, the optical filters are tuned such that each element in the array has a predetermined signal to thereby adjust the time gradient across the array to steer the beam.

13 Claims, 5 Drawing Sheets

PHOTONIC PHASE AND TIME DELAY-STEERED ARRAYS

CROSS REFERENCE TO RELATED APPLICATION

This is a continuation-in-part of application Ser. No. 08/778,201, filed Dec. 30, 1996, now U.S. Pat. No. 5,977,911, the specification of which is incorporated by reference herein in its entirety.

BACKGROUND OF THE INVENTION

1. Field of the Invention

This invention relates to electronically-steerable antenna arrays for use in high frequency bands, such as SHF (3 gigahertz (GHz) to 30 GHz) and EHF (31 GHz to 300 GHz). The beam of such an antenna array is steerable by varying the phase gradient, or more broadly, the time gradient, across the array. More particularly, the invention relates to the use of lasers and other photonic components to perform the steering functions in the phased array.

2. Background Information and Description of the Prior Art

Antenna arrays are composed of a number of radiating elements suitably spaced with respect to one another. The beam of such an array can be steered in space by properly varying the phase gradient across the array, i.e. by varying the relative phases of the signals applied to the respective antenna elements. A number of devices are known which can provide the variable phase gradients.

More specifically, variable phase shifters can be used to obtain the desired phase (gradient across an array. In such an array, typically one phase shifter is needed per antenna element. Alternatively, a set of fixed phase shifters can be used, with associated switching components which provide for switching of the signal of a selected phase to each antenna element.

Antenna arrays are often used in applications such as aircraft and satellites. In these applications, space and weight constraints are, of course, highly significant. In addition, there is not a great deal of flexibility as to the location of component parts in such applications. Moreover, when EHF frequencies are involved, the space between antenna elements may be as small as ⅛ inch or less. This places further restrictions on the numbers and types of components that can be placed physically proximate to the elements themselves.

Variable phase shifters are not particularly useful in these applications because they can be bulky and complex. Further, variable phase shifters are not readily available at EHF frequencies. Similarly, fixed phase shifters can also be bulky, but more importantly, the switching matrix needed with fixed phase shifters can be large and complex.

One solution would be to locate the variable phase shifters, or the switching matrix if fixed phase shifters are used, at a position remote from the array. However, such a design would require a separate transmission line to be run from each antenna element to a variable phase shifter or switching circuit. Cutting and routing each line involves a cumbersome and labor intensive manufacturing step. Thus, the above-described solutions do not appear to be effective.

There remains a need, therefore, for a phased array for use in the microwave frequency bands, such as SHF and EHF, which conforms to the available space requirements in aircraft, satellites and other such environments and which array is relatively light-weight, low-cost and uses readily available components. Furthermore, there remains a need for such an array in which the phase shifters and switching components do not have to be physically proximate to the array elements.

SUMMARY OF THE INVENTION

A phased array system incorporation the present invention includes a switching unit that uses lasers and an optical tuning network to switch RF signals of the appropriate phase to the respective antenna elements. Portions of the switching unit can be remotely located from the array elements. An array unit includes the tuning portion of the switching unit, the array elements and their associated transmit and receive modules.

An RF input signal is simultaneously applied to an appropriate number of fixed phase shifters. The number of phase shifters corresponds to the number of phase states within the particular array. In the switching unit, each resulting signal, which is of a particular phase, modulates a laser of a different color. Each different laser color is thus associated with a given RF phase. The laser signals are combined and the resulting composite signal is carried on a single optical fiber from the switching unit to an optical tuning network which includes a bank of optical filters located adjacent to the array elements.

In the optical tuning network, a separately tunable optical filter is associated with each antenna element in the array. The optical filters are tuned by an associated beam-steering controller to pass through each filter a particular laser color, thus selecting a desired phase for each antenna element.

With respect to transmission, each antenna element has an associated transmit module in which a photodiode detects (i.e. demodulates) the selected optical signal from the tunable filter associated with that element. The resulting RF signal is amplified and then transmitted from the element. A plurality of such signals are radiated, with the beam ultimately formed by such signals being steered by the selection of the phase gradient across the array, i.e. by selectively tuning the optical filters.

On reception, a signal from a desired direction induces in the respective antenna elements voltages having a corresponding phase gradient. These voltages are applied to receive modules connected to the respective antenna elements. Each receive module has an additional input from the associated tunable filter, i.e. an optical signal modulated with an RF signal whose phase corresponds to the phase of the received RF signal at the associated antenna element. The optical signal is demodulated and the resulting RF signal is mixed with the received RF signal. The product is an IF signal which then modulates a laser. The resulting optical signal can be combined with the other signals from the various antenna elements and the composite optical signal can be carried on a single fiber to a desired location where subsequent processing is performed. The signals ultimately obtained are used for communication or radar information as appropriate in the particular application.

The phased array system of the present invention allows for combination of signals on a single optical fiber. This facilitates location of some elements of the switching system remotely from the array. In addition, the electronics located proximate to the antenna elements can be printed on a single chip, thus allowing greater conformance to the available space requirements. Further, the components are lightweight and low-cost.

In certain circumstances, instead of phase selection, differential time delay steering can then be used. The time delays can be accomplished with varying lengths of RF line. For large arrays, including multiple sub-arrays, another embodiment of the invention incorporates time delay units for time-shifting respective sections of the array, and a phase selection switching unit can be used for selection of the phase to be applied to individual elements in each section.

Another embodiment of the invention provides modulation of transmitted RF signals in an EHF frequency range at which modulators are not readily available. In that case, the switching unit includes a number of laser pairs of different colors, the frequencies of the lasers in each pair being separated by the desired RF frequency. The lasers in each pair are frequency-locked together by means of an associated phase lock loop which includes an optical detector to which the laser outputs are applied. The resulting RF output of the detector is compared in phase with an RF reference. The loop adjusts the frequency of one of the lasers to bring the phase (and frequency) of the detector output into alignment with the reference. The same reference is used for all the lasers. The output of one of the lasers in each pair is amplitude-modulated with a baseband signal by a readily available, inexpensive optical modulator. However, each modulation is performed with a version of the baseband signal having a different phase.

In this embodiment, the tunable filter in the optical tuning network passes the signals from a single laser pair, since the frequencies of the lasers in each pair are sufficiently close. Since the optical detector in the transmit or receive module is a square-law device it provides an output that includes an RF signal having a relative phase which corresponds to the relative phase of the baseband modulation signal present in the laser signals passed by the filter.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
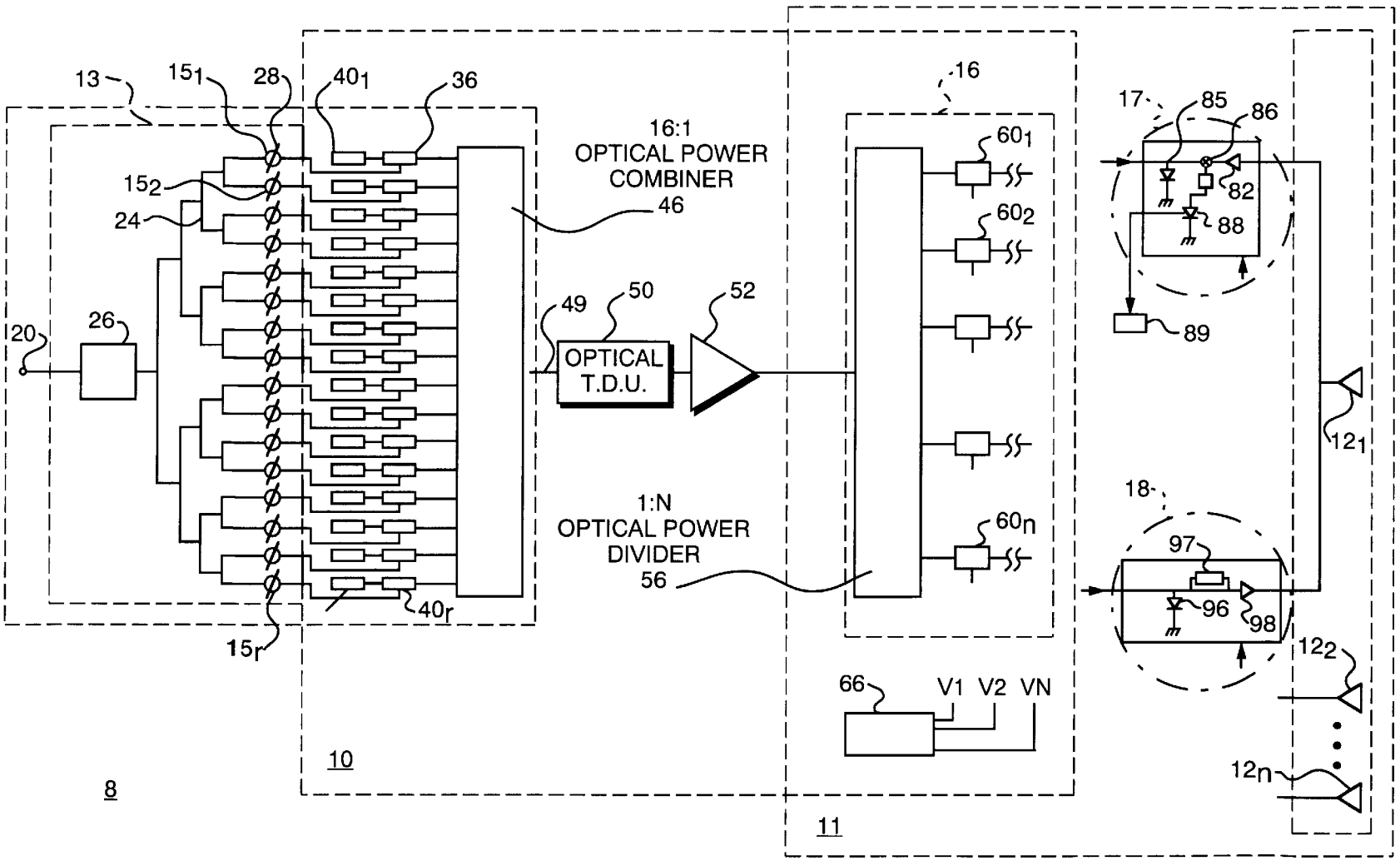
FIG. 1 is a block diagram of the photonic phased array including the switching unit and optical tuning network embodying the present invention.

As shown in FIG. 1, an antenna array steering circuit 8 adjusts the phase gradient, or more broadly, the time gradient, across an associated antenna array. More specifically, an antenna array unit 11 includes a plurality of antenna elements $\mathbf{12}_1$–$\mathbf{12}_N$ with each antenna element having an associated receive module 17 and a transmit module 18. The steering circuit 8 includes a network 13 of fixed RF phase shifters $\mathbf{15}_1$–$\mathbf{15}_R$, and an optical tuning network 16. A switching unit 10 performs the switching to select the appropriately phased signal to be applied to each antenna element, such as the element $\mathbf{12}_1$.

The phase shifter network 13 has an input 20 to which an R source signal, which may be in the C-band, the X-band or other microwave frequency band, is applied. The signal is divided and applied to the phase shifters $\mathbf{15}_1 \ldots \mathbf{15}_R$, each of which imparts a different phase shift to the applied RF input. In the example shown in FIG. 1, there are 16 phase shifters corresponding to the 16 phase shift bit states for producing the various phases for application to the respective antenna elements $\mathbf{12}_1 \ldots \mathbf{12}_N$.

The switching unit 10 includes a bank of lasers $\mathbf{40}_1$–$\mathbf{40}_R$, each laser having a different color, (i.e., a different frequency). The signal produced by each of the phase shifters, $\mathbf{15}_1$–$\mathbf{15}_R$, amplitude-modulates a laser of a different color. In this way, the color of each laser is associated with a particular RF phase. The phases of the various lasers $\mathbf{40}_{1\text{-}R}$ may be adjusted, if desired, using phase adjusters, preferably, piezoelectric units, so that for a particular direction selected, the correct relative phases are present for that direction.

These modulated optical signals are fed to a 16:1 optical power combiner 46. The resulting composite signal is carried on a single optical fiber 49 which runs from the optical power combiner 46 to the antenna array unit 11, and specifically, to an optical tuning network 16.

The tuning network 16 includes a 1:N optical power divider 56, where, as stated, N is the number of elements in the antenna array. The network 16 also includes tunable optical filters $\mathbf{60}_1 \ldots \mathbf{60}_N$, one filter being associated with each antenna element, $\mathbf{12}_1 \ldots \mathbf{12}_N$. A beam-steering controller 66 is connected to the optical tuning network 16 by way of individual leads $V_1 \ldots V_N$, each of which applies a control voltage to one of the individual filters $\mathbf{60}_1$ through $\mathbf{60}_N$. In this way, each filter $\mathbf{60}_1$ passes a signal of a selected color and thus a different desired phase is selected for each element $\mathbf{12}_1$ in the antenna array 11.

Each antenna element, such as the element $\mathbf{12}_1$, has associated with it a receive module 17 and a transmit module 18. A switch (not shown in FIG. 1) switches the element $\mathbf{12}_1$ between transmit mode and receive mode, as desired. In the receive mode, a signal is received by antenna element $\mathbf{12}_1$, which signal may be a modulated RF signal, or it may be an unmodulated signal received as a radar echo. The incoming signal is first amplified by amplifier 82. The receive module has, as a second input, the signal from the optical filter that is associated with that antenna element. The modulation of that signal is of the particular phase selected for that element $\mathbf{12}_1$. This optical signal is detected by a photodiode 85 and the resulting local RF signal is multiplied, by the mixer 86, with the incoming RF signal.

The IF signal thus produced, has a phase value which depends upon the difference between the phases of the two signals applied to the mixer 86 and it drives a laser diode 88. The resulting optical signal is combined with the optical signals from the other receive modules 17 for the remaining array elements and routed to photodetector 89. One exemplary RF combiner which may be used is described in U.S. patent application Ser. No. 08/778,201, filed Dec. 30, 1996, cited herein.

Each antenna element also has a transmit module 18, which will be on the same chip as the receive module 17. The signal to be transmitted from that element has a particular phase which is selected by means of the optical tuning network 16, as described above. The RF modulation of the laser 40 is recovered by detection in a photodiode 96 and the resulting RF signal is amplified by amplifier 98 and transmitted by an antenna element 12.

The switching unit 10 of the present invention facilitates the location of the phase shifters at a site which is remote from the array itself. Furthermore, the ability to carry the composite signal on a single fiber avoids skewing problems without having to cut individual transmission lines to exact lengths. In addition, the photonics components which are used are simple, low power and readily available.

Figure 2:
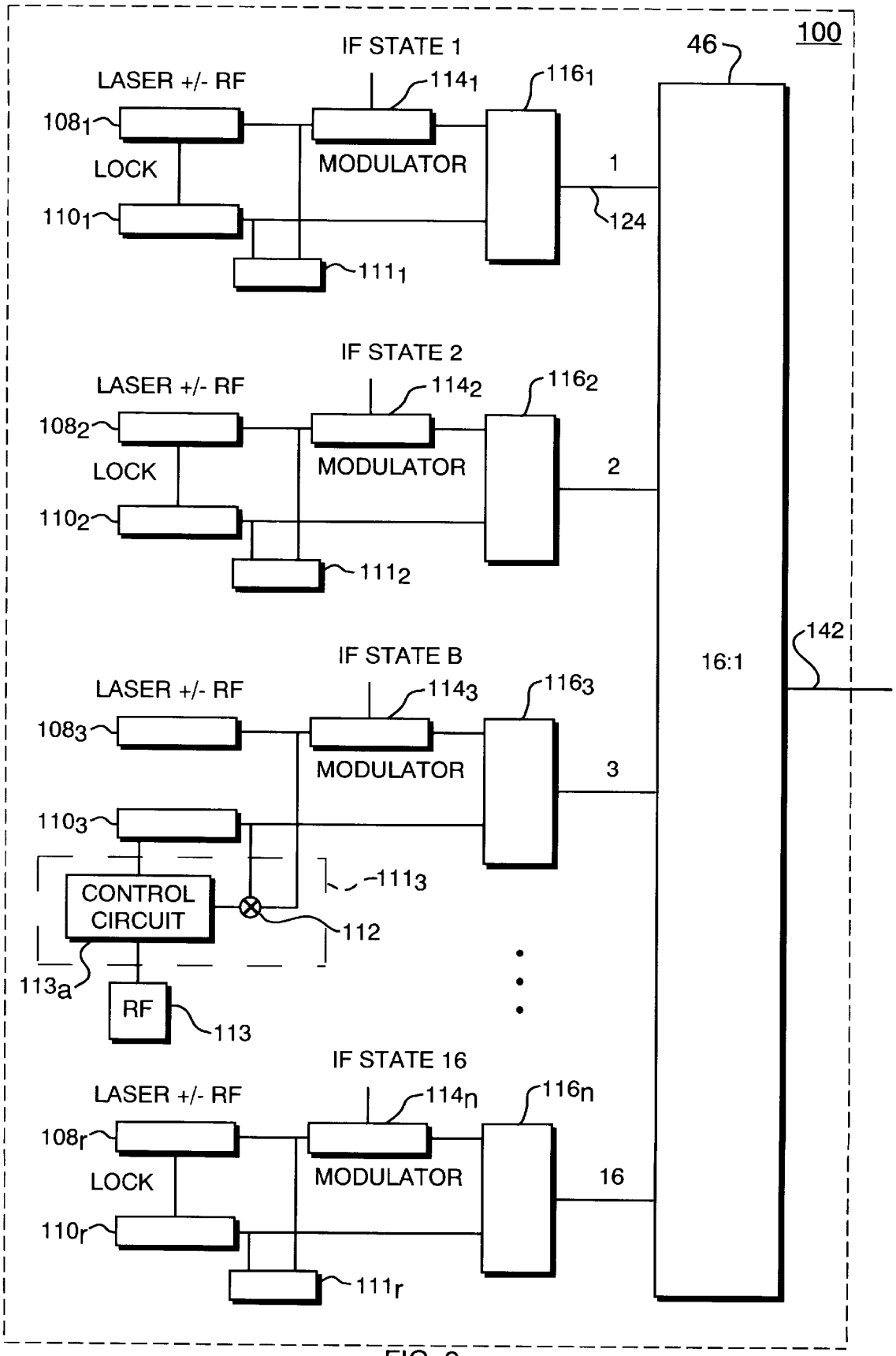
FIG. 2 is a block diagram of a portion of the switching unit in which each optical signal is generated by mixing two laser signals.

FIG. 2 illustrates another embodiment of the invention in which the transmitted signal is modulated. It is particularly useful at EHF frequencies, where modulators are not fully developed, or in circumstances in which RF modulators may be too costly. A phase state generator 100 (FIG. 2) produces signals of the desired phases for use in the switching unit 10 of FIG. 1. The generator 100 includes a set of laser pairs, $\mathbf{108}_{1 \ldots R}$, $\mathbf{110}_{1 \ldots R}$. The lasers $\mathbf{108}_i$, $\mathbf{110}_i$ in each pair are frequency-locked together by means of a phase lock loop $\mathbf{111}_i$. Referring to phase lock loop $\mathbf{111}_3$ which is shove in detail in FIG. 2, a portion of the output of each laser $\mathbf{108}_3$ and $\mathbf{110}_3$ is applied to an optical detector 112. The RF output of the detector 112 is compared in phase with an RF reference source 113. A control circuit 113*a* adjusts the frequency of one of the lasers, such as the laser $\mathbf{110}_3$ to bring the phase (and frequency) of the detector output into alignment with the reference 113. The same reference is used for all of the lasers 108*i*, $\mathbf{110}_i$. In this way, the lasers in each pair are phase locked, and the frequency difference between the two lasers in the pair is the desired RF frequency and is phase-locked to the reference source 113.

One of the lasers in the pair, such as the laser $\mathbf{108}_i$, in FIG. 2, is amplitude-modulated by a modulator 114 with a baseband information signal. Each modulation is performed on one of the lasers in each pair with a version of the baseband signal having a different phase. Thus, each laser pair $\mathbf{108}_i$, $\mathbf{101}_i$, is associated with a different phase. Specifically, the phase differences between the lasers in the laser pairs $\mathbf{108}_i$, $\mathbf{110}_i$ are all the same due to the phase lock loops 111 using the same reference 113 for comparison. Thus, the relative phases of the resulting signals after the modulation with respect to each laser pair correspond to the relative phases of the modulation. Each of the laser pairs has a different pair of frequencies (colors) from those of the other laser pairs. As a result, each pair of lasers is associated with a different modulation phase.

The signals from each laser pair, $\mathbf{108}_i$, $\mathbf{110}_i$, are combined in optical combiners $\mathbf{116}_i$ and then in an optical combiner 46 with the signals from the other laser pairs. The resulting composite signal is carried on a single fiber 142 to the array unit 11 (FIG. 1). The switching for selection of the phases for the individual antenna elements is accomplished in a manner similar to that described with reference to FIG. 1. Specifically, each tunable optical filter $\mathbf{60}_i$ has a bandwidth such that it will pass both colors from the laser pair. The detector 96 of the transmit module 18 (FIG. 1), which receives the output of the filter $\mathbf{60}_i$, is a square law device which thus multiplies the inputs. The detector 96 therefore provides an output at the beat frequency of the two laser colors. Two sidebands result from the amplitude modulation. One of the two sidebands and the carrier frequency are filtered out, using filter 97, which can be readily implemented, if desired, in the module 18 circuitry, as will be understood by those skilled in the art. If desired, balanced modulators $\mathbf{114}_i$ can be used to eliminate the carrier frequency from the modulation outputs. The resulting RF output is of a phase which corresponds to the phase of the modulation and the phase difference of the laser pairs $\mathbf{108}_i$, $\mathbf{110}_i$, which phase difference, as stated, is a constant for all laser pairs in the phase state generator 100.

Figure 3:
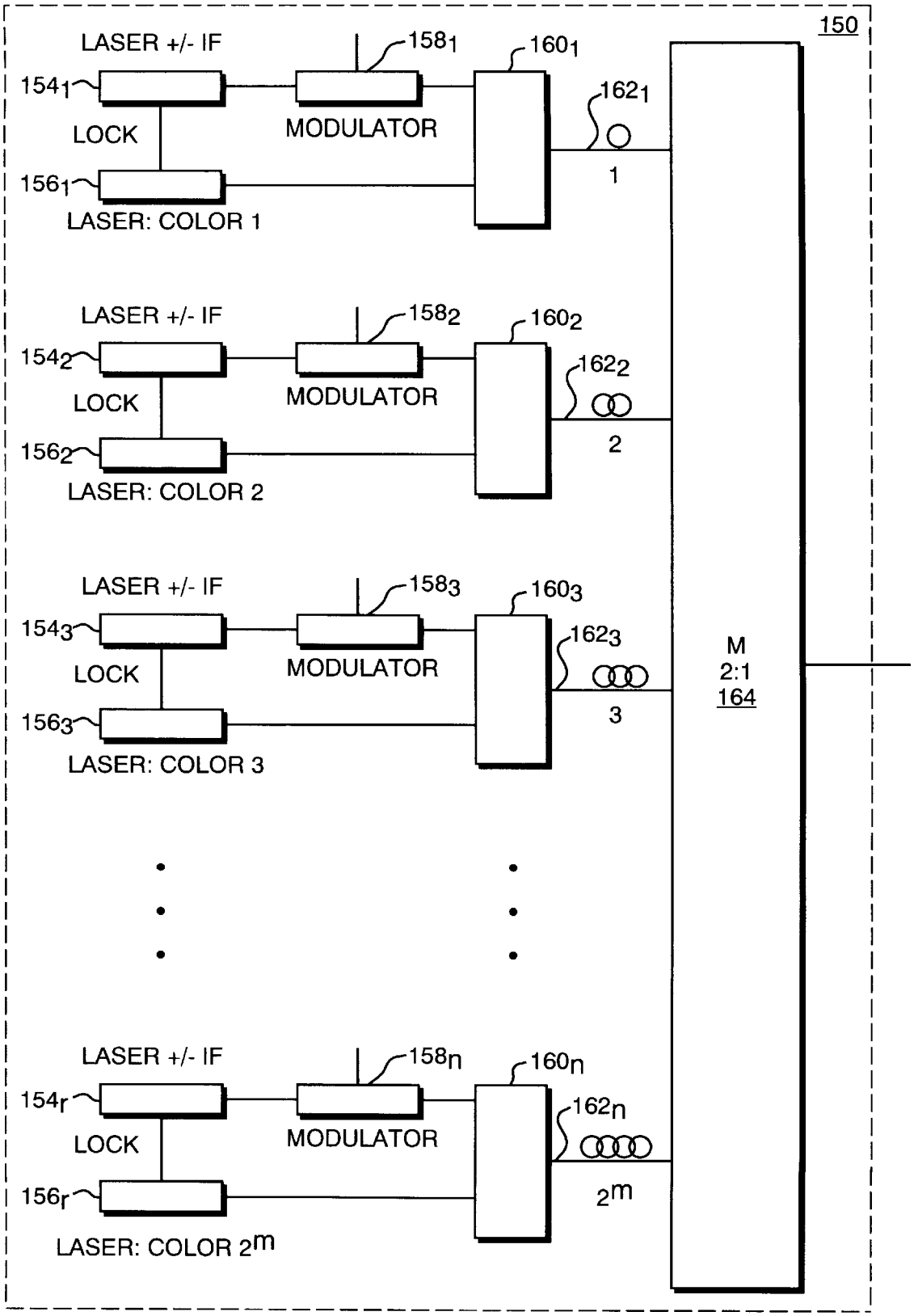
FIG. 3 is a block diagram of a time delay switching unit in which signals are generated using two mixed laser signals.

In certain circumstances, it will be preferable to use time delay steering in the system of FIG. 2 instead of phase steering. Specifically, in circumstances in which the modulation contains multiple frequencies, phase steering will impart different time delays to different frequency components. In time delay steering, a time delay unit controls the path length differences from the array elements to the desired RF wavefront and all frequency components therefore have the same time delay. An arrangement of this type is illustrated in FIG. 3. Specifically, as shown in FIG. 3, a time delay state generator 150 includes laser pairs $\mathbf{154}_{1 \ldots R}$, $\mathbf{156}_{1 \ldots R}$. In a manner similar to that described with reference to FIG. 2, each laser $\mathbf{154}_i$ is frequency-locked to its associated laser $\mathbf{156}_i$. The difference in frequency between the lasers in each pair is the desired RF frequency.

Modulation is performed in the same manner as that described with reference to FIG. 2, with the baseband information signal modulating the output of each laser $\mathbf{154}_i$, by means of a modulator $\mathbf{158}_i$. However, in this case, the same modulation signals are applied to all the modulators, i.e., with the same phases. The modulated signal is combined in an optical combiner $\mathbf{160}_i$ with the signal from the associated laser $\mathbf{156}_1$. The combined signals are carried by fibers $\mathbf{162}_{1 \ldots N}$ to a power combiner 164. However, in addition, each of the optical fibers $\mathbf{162}_i$ is of a length which creates a time delay different from that of the next fiber $\mathbf{162}_i$. Incremental time delays in the signals are thus implemented by different lengths of line.

Figure 4:
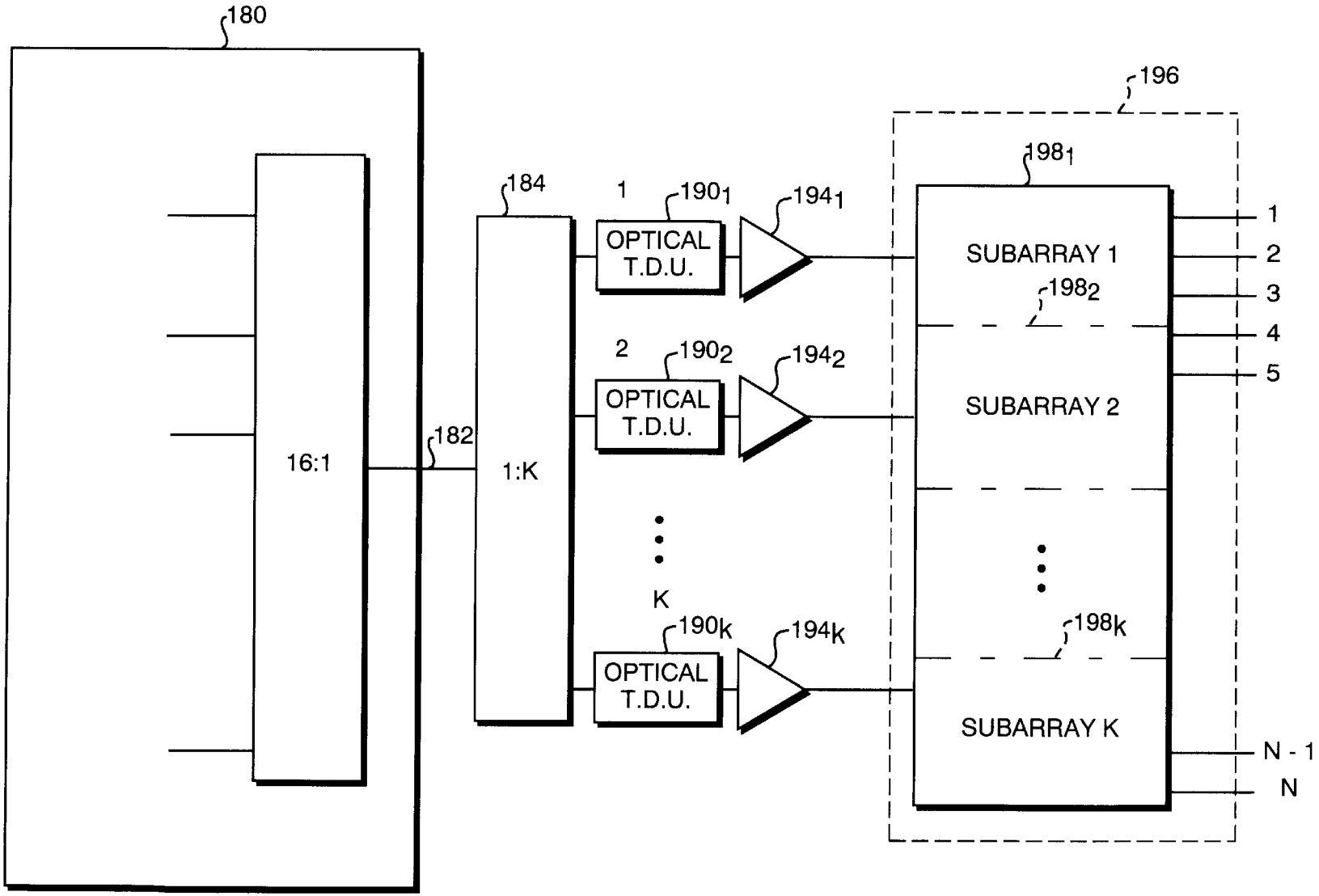
FIG. 4 is a block diagram of a combined phase and time delay-based switching unit.

A combined time delay and phase-steered device for use with antenna arrays having subarrays which are separately steered is shown in FIG. 4. A phase state generator 180 may be either a network 13 of fixed phase shifters as shown in FIG. 1, a phase state generator 100 employing the laser pairs of FIG. 2, or the time delay-based unit 150 of FIG. 3. A combined, single output from the phase state generator 180 is transmitted on optical fiber 182 to an optical power divider 184. A plurality of K time delay units, $\mathbf{190}_{1 \ldots K}$ equal in number to the K subarrays, are connected between an optical power divider 184 and amplifiers $\mathbf{194}_{1 \ldots K}$. The outputs of the amplifiers $\mathbf{194}_{1 \ldots K}$ are connected to an array unit 196 that includes a plurality of K subarrays $\mathbf{198}_{1 \ldots K}$. A switch (not shown) within each subarray 198, through $\mathbf{198}_K$ allows selection of the signals from any one time delay unit to be switched to that subarray such that the output of the associated amplifier $\mathbf{194}_i$ is selected for that subarray $\mathbf{198}_i$.

The time delay unit $\mathbf{190}_i$ applies a time delay offset to all the signals which drive the respective elements for that portion of the array. Within each subarray, the individual signals to be applied to the respective elements are selected from the 1:K power divider 184 in the same manner as that described with reference to the other Figures. Specifically, an optical tuning device (not shown in FIG. 4) is used to select a signal of a particular laser color, which signal has a predetermined phase or time delay state. This signal is then applied to the individual antenna element, as discussed herein. In this way, the beam for the entire array is steered.

Figure 5:
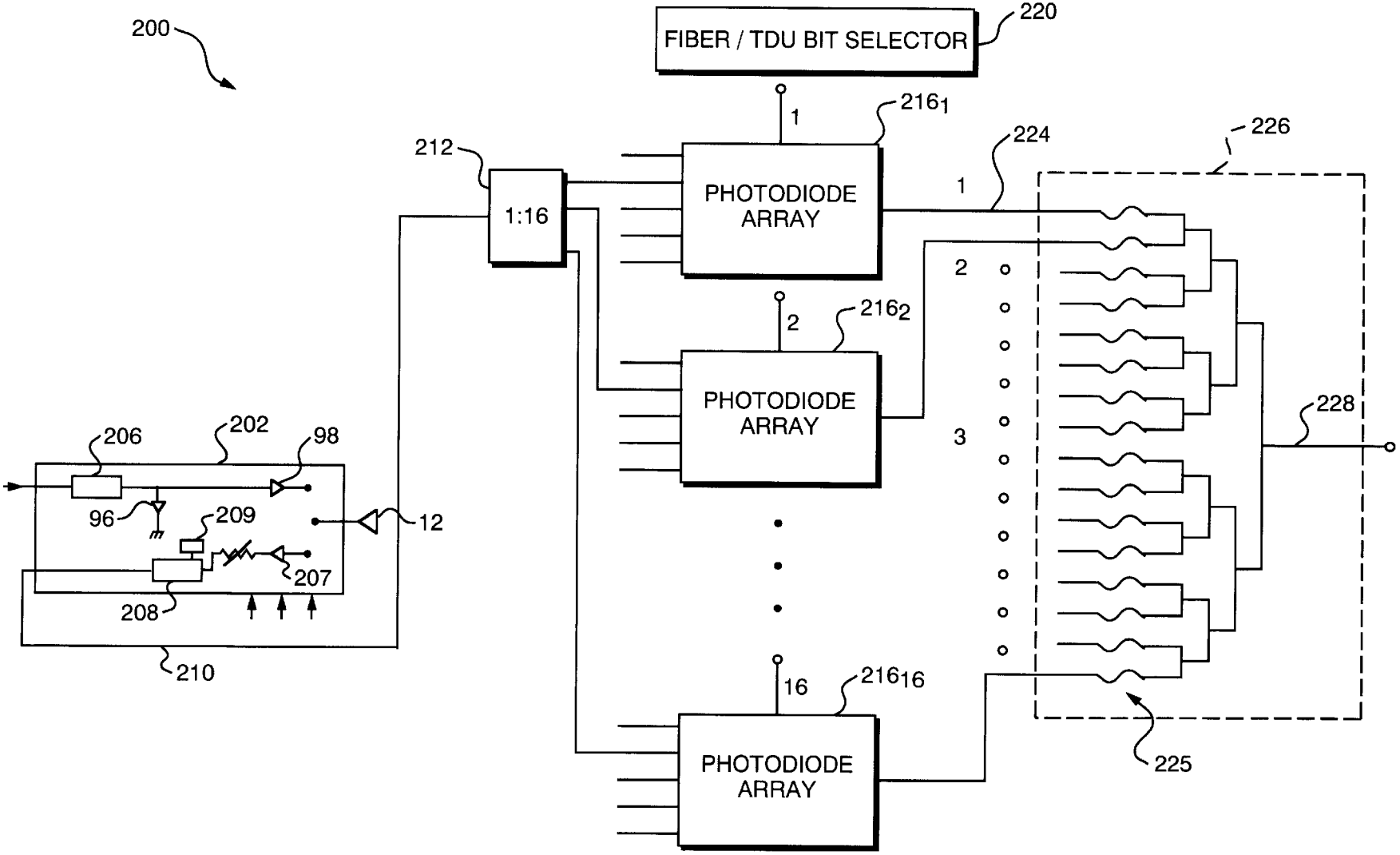
FIG. 5 is a block diagram of one embodiment of a receive circuit for use with the switching unit embodying the present invention.

FIG. 5 illustrates another embodiment of the invention in which a receiver circuit 200 steers the antenna for RF reception. Each antenna element 12 in the array (not shown in its entirety) has an associated transmit/receive module 202. An incoming RF signal received by the element 12 is amplified by an amplifier 207. The received signal modulates a laser 209. The laser output is carried on a fiber 210 to an optical power divider 212 associated with that antenna element. Each divider 212 splits its input signal to a plurality of photodiode arrays $\mathbf{216}_{1 \ldots 16}$, the number of photodiode arrays corresponding to the number of available time delay states. The output of each photodiode array $\mathbf{216}_i$ is impressed with a different, fixed time delay by a time delay unit 225 in a power combiner 226.

A selector 220 performs the switching to determine which input signal to the photodiode array $\mathbf{216}_i$ is to be impressed with the time delay associated with that array. Selector 220 may be, for example, a bias control unit having switches for switching the bias off at all photodiodes except that photodiode in each array corresponding to the antenna element to which the time delay of that array is to be impressed. The resulting signals having the respective time delays are combined in the RF power combiner 226 to produce at the RF output port 228 a sum of the time-delayed signals from the respective antenna elements.

The present invention thus provides a low cost, readily available steering system in which the components for phase or time delay selection can be located remotely from the array elements. This facilitates reliable communication or radar at microwave frequencies in environments having substantial space constraints. Further, the combined signals can be carried within the switching unit on a single fiber, thus avoiding a need for individually cut and routed transmission lines.

The terms and expressions employed herein are used as terms of description and not of limitation, and there is no intention, in the use of such terms and expressions, of excluding any equivalents of the features shown and described or portions thereof, but it is recognized that the various modifications are possible within the scope of the invention claimed.

What is claimed is:

1. A switching unit for use with an antenna array which has a set of antenna elements for producing a beam that can be steered by varying the phase gradient across the array, and said switching unit has associated therewith an input source producing an RF input signal, the switching unit comprising:

(A) means for producing a plurality of signals of graduated phases from said input signal, the phase of each signal being shifted such that each signal is of a different phase;

(B) a set of lasers, each laser being of a different color and producing an output signal, and each of said laser output signals being modulated by one of said phase-shifted signals such that a modulated laser signal of a given color corresponds to a particular phase of said modulation;

(C) optical power combiner for combining said modulated laser signals to produce a composite output signal that is carried on a single fiber; and (D) optical network means connected to receive said composite output signal and having a tunable optical filter for each antenna element in said array, and said filters being tunable for selection of a particular laser color such that when a laser signal of a particular color is selected, the signal of the desired phase associated with that color is selected for that element in the array, whereby the phase gradient across the array is adjusted; and (E) means for converting said optical signals to radio frequency signals prior to said signals being applied to said antenna elements of said array.

2. The switching unit as defined in claim 1 wherein:

said means for producing said plurality of signals of graduated phases includes a power divider coupled with a set of fixed phase shifters, said power divider being adapted to receive said RF input signal and split said input signal to said phase shifters, whereby each phase shifter produces an output signal of a different phase.

3. The switching unit as defined in claim 1 wherein:

said means for producing said plurality of signals of graduated phases includes a set of laser pairs, and a phase lock loop associated with each laser pair, and each phase lock loop comparing the frequency of the lasers in each said pair to the same RF source of a predetermined RF frequency, such that said lasers in said laser pairs are frequency-locked in such a manner that the frequency difference between the lasers in each pair is equal to a predetermined RF frequency, and such that the phase difference of each laser pair is the same value, and one of said lasers in each pair being modulated by an input signal which is a baseband signal of a particular phase, and also including an optical combiner for combining said two lasers signals after said one of said signals is modulated, to produce a modulated optical signal of a particular phase.

4. The switching unit as defined in claim 1 wherein:

said means for producing said plurality of signals of graduated phases includes a set of laser pairs, such laser pairs being frequency-locked such that the frequency difference between the lasers in each pair is equal to a predetermined RF frequency, and one of said lasers in each pair being modulated by a baseband signal derived from said input signal, and also including time delay means associated with each modulated optical signal for producing a particular time delay state for each signal.

5. The switching unit as defined in claim 1 further comprising:

an optical transmission line coupled between said power combiner means and said optical network means for carrying said composite signal from said laser set to said optical network.

6. The switching unit as defined in claim 5 further comprising:

an optical time delay unit and an optical amplifier disposed between said power combiner and said optical network.

7. The switching unit as defined in claim 1 further comprising:

a beam-steering unit having means for tuning each optical filter to select a laser color, and thus a phase to be associated with each element of said array.

8. An electronically-steered phased array having an RF input source signal at a microwave frequency, the phased array comprising:

(A) a plurality of spaced antenna elements for producing a beam, said beam being steerable by varying the phase gradient across the array;

(B) phase shifted signal generator means connected to receive said RF input source signal and producing therefrom a plurality of RF signals, each of a different phase;

(C) switching means including:

(1) laser bank means having a plurality of lasers each of a different color and each producing an output signal;

(2) modulator connected to modulate each laser output signal with one of said signals of a particular phase such that each laser color is associated with a particular phase;

(D) optical power combiner means connected to receive said modulated laser signals in parallel and to produce a composite output signal which is carried on a single fiber;

(E) optical select network having power divider means connected to receive said composite output signal, and a plurality of tunable optical filters, one of said filters being associated with each one of said antenna elements;

(F) means for converting said optical signals to radio frequency signals; and (G) beam-steering unit connected to said optical filters in such a manner that a particular laser color, and thus a different time-dependent state, is selected and a radio frequency signal converted from said optical signal is applied to each antenna element in the array.

9. The phased array as defined in claim 8 wherein:

said phase-shifted generator means includes a plurality of phase shifters connected to receive said RF input source signal of a particular phase and said lasers thus being associated with a given phase.

10. The phased array as defined in claim 8 wherein:

said optical select network includes a plurality of subarrays each including a number of antenna elements, and an optical time delay unit being connected between said power divider and each said subarray in such a manner that a predetermined time delay is introduced into the composite output signal applied to each subarray whereby a desired time offset is introduced into the composite output signal for each subarray.

11. The phased array as defined in claim 10 wherein:

each antenna element includes a receive module connected to receive as a first input external RF signals and, as a second input, said selected laser signal, and also including:

(A) photodiode means for detecting said laser signal to produce an RF modulating signal;

(B) an input receiving means for receiving said external signal from an outside source, and amplification means for amplifying said external signal;

(C) mixing means for multiplying said RF modulating signal and said amplified external signal to produce an IF signal;

(D) laser diode means to re-convert said IF signal to optical wavelengths, producing an optical receive signal; and (E) photodetector and combiner means to combine said optical receive signal with signals from other antenna elements in the array.

12. The phased array as defined in claim 11 wherein:

each said antenna element includes a transmit module connected to receive the laser signal selected for that element, and photodiode means for detecting said laser signal to produce an RF transmission signal, and amplification means for amplifying said RF transmission signal.

13. The phased array as defined in claim 8 further comprising:

a receiver circuit coupled with each said antenna element, said receiver circuit including:

(A) a plurality of laser means, each laser means modulating an incoming RF signal from each said antenna element, (B) a power divider means associated with each antenna element and being connected to receive a modulated laser signal that from that element and to split that signal into a plurality of individual signals, (C) a plurality of photodiode arrays connected to receive as inputs, one of said individual signals from each of said power dividers associated with said antenna elements, and each said photodiode array being coupled with a time delay implementation means which imparts a predetermined time offset to an output signal form said photodiode array, (D) switching means coupled with said photodiode arrays for selecting the modulated laser as the output of that photodiode array to be impressed with the time offset for that array, and (E) optical power combiner means for receiving said output signals from said photodiode arrays with said time offsets and summing said output signals.

* * * * *